US005524760A

United States Patent [19]

Funk

[11] Patent Number: 5,524,760

[45] Date of Patent: Jun. 11, 1996

[54] INTERLOCKING APPARATUS FOR STACKED CARTONS AND METHOD FOR USING THE SAME

[75] Inventor: Lyn Funk, Clovis, Calif.

[73] Assignee: Laminations Corporation, Neenan, Wis.

[21] Appl. No.: 231,006

[22] Filed: Apr. 21, 1994

(Under 37 CFR 1.47)

[51] Int. Cl.[6] ..... B65D 21/024

[52] U.S. Cl. ..... 206/504; 206/386; 206/511; 220/23.4; 220/23.6; 229/915

[58] Field of Search ..... 24/287; 52/459, 52/800.11; 206/386, 504, 509, 511; 220/23.2, 23.4, 23.6; 229/915; 403/205, 403

[56] References Cited

U.S. PATENT DOCUMENTS 5,054,636 10/1991 Netzer ..... 206/504
5,181,297 1/1993 Andrew, Jr. et al. ..... 220/23.4
5,251,753 10/1993 Pigott et al. ..... 206/386
5,465,533 11/1995 Rummo, Jr. et al. ..... 403/403

*Primary Examiner*—Gary E. Elkins
*Attorney, Agent, or Firm*—Wheeler Kromholz & Manion

[57] ABSTRACT

An apparatus for interlocking the top layer of corrugated cardboard cartons in a palletized load of said cartons while also providing edge protection, load containment, a flat even surface to stack additional palletized loads upon, and the ability to stack palletized units of boxed product while not damaging the stacking tabs used in produce corrugated cardboard carton designs. The apparatus has two sides at substantially right angles to each other that meet to form an edge. Material is removed from at least one side to create a plurality of slots for receiving the stacking tabs in the tops of the corrugated cardboard cartons. The apparatus is placed on the edge of the upper layer of cartons on a palletized load to interlock the cartons for greater load stability and to reduce load failure.

9 Claims, 1 Drawing Sheet

INTERLOCKING APPARATUS FOR STACKED CARTONS AND METHOD FOR USING THE SAME

BACKGROUND OF THE INVENTION

Corrugated cardboard cartons used in the fruit packing industry, commonly referred to as bliss boxes, have stacking tabs on each carton top. These tabs aid in the stacking process by fitting into corresponding slots in the bottom of the carton placed upon it. The cartons are stacked on pallets (palletized) typically three (3) cartons wide, two (2) cartons deep, and up to twelve (12) cartons high. On each carton layer, the top tabs are inserted into the bottom slots to interlock the cartons on top of one another.

Due to storage limitations and transportation restrictions, fruit packers often find it necessary to stack palletized corrugated cardboard cartons three (3) pallets high in cold storage or high humidity environments. Corrugated cardboard boxes do not react well in such environments and most efforts to improve corrugated box performance have not been successful.

When stacking palletized corrugated cardboard cartons on top of one another, load failure often occurs when one carton is dislodged or collapses. Furthermore, during shipping, vibration and load shifting can easily cause a carton to dislodge or collapse and cause other palletized cartons above it to fall. In both situations, the contents of the cartons are often damaged or destroyed.

There are at least three inherent weaknesses with the present corrugated cardboard carton stacking system. First, the stacking tabs of the top layer of cartons are not inserted into any slots. These tabs are left unconnected and are often crushed by the pallet that is placed on top of the top carton layer. A carton with crushed stacking tabs cannot be reused as its tabs will not properly interlock with the bottom slots of a carton placed above it. Second, while the bottom layer of cartons all rest on the pallet and thus are held together on this commonly shared surface, the top layer of cartons are not interconnected. Each stack of cartons resembles a stack of blocks that can easily topple or fall. Third, if a second pallet is stacked on top of the first palletized group of cartons, there is no edge protection for the top layer of cartons upon which the second pallet is placed. If the second pallet should contact the edges of the top layer of cartons during stacking with a sufficient force, the carton edges and sides are typically damaged. Because corrugated cardboard cartons rely on their edges and sides for a majority of their structural strength, once damaged the cartons are incapable of supporting one or more palletized loads.

My invention solves the above problems. Its many objects include providing edge protection, load containment, and the ability to stack palletized units of boxed product while not damaging the special stacking tabs inherent in a corrugated cardboard box design. Another object of my invention is to provide a flat even surface for the next palletized load to be stacked upon. Furthermore, my invention is reusable from palletized load to palletized load.

SUMMARY OF THE INVENTION

The present invention has two sides or margins which are joined at substantially a fight angle and have a common edge. Elongated slots are cut in one or both sides. These slots effectively create voids for receiving the stacking tabs of corrugated cardboard cartons commonly used to pack fruit. My invention enables the stacking of unitized loads on top of one another in storage or transit environments.

The preferable material used is for each interlocking apparatus is a laminated paper composite. Strips of paper are glued together, bent at substantially a right angle along the longitudinal axes of the strips, and placed under pressure until the glue has dried thus giving the my invention its rigidity. Alternatively, my invention could be manufactured from any other suitable material.

The location as well as the length and width of each slot varies with the stacking tabs on the corresponding corrugated cardboard cartons. While there is some carton uniformity within the industry, the locations and dimensions the slots in my interlocking apparatus are easily changed during the manufacturing process. In some applications, a few long slots that can each receive a plurality of tabs are used so that the same apparatus can be used for a variety of carton tab configurations. In other applications, short slots that correspond the exact location and dimension of each tab are required.

Alternatively, my invention could be described as a method where when corrugated cardboard cartons are stacked on a pallet, they are arranged such that the longitudinal axis of each stacking tab on each carton top located on the side of the pallet lies in a common line. After the top layer of cartons has been placed on the pallet, the interlocking apparatus is placed over the edge of the adjacent top layer of cartons such that the tabs are received within the corresponding apparatus slots. My invention protects the edges of the top layer of cartons and also interlocks the top layer of cartons to which it is attached. If one or more additional pallets are to be stacked on top of the first pallet, the next pallet will not crush the stacking tabs of the top layer of cartons. After the new pallet is removed, the cartons on the lower pallet can be restacked if necessary and those on the top layer can be placed anywhere on the unitized load.

Because my invention is not permanently attached to the edges of the palletized cartons, it is fully reusable.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
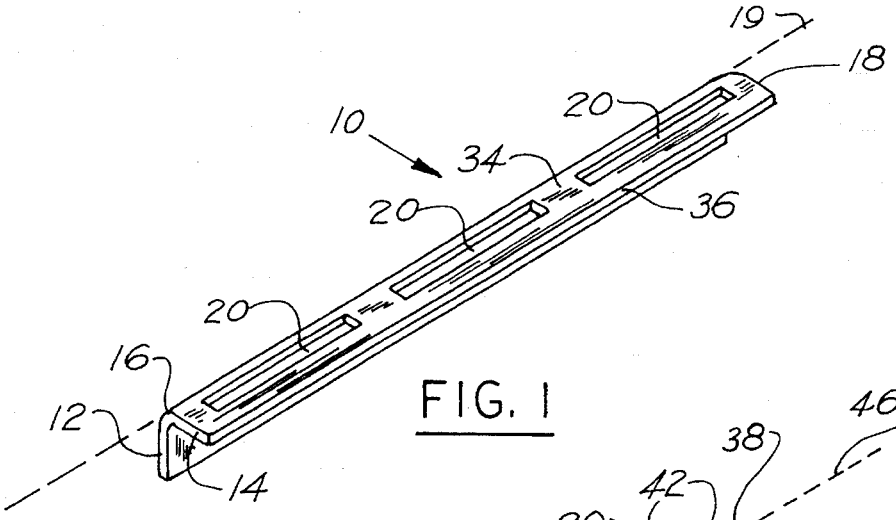
FIG. 1 is a top perspective view of my invention.

With reference to the drawings in general, and to FIG. 1 in particular, my interlocking apparatus for stacked cartons is generally shown as 10.

Figure 3:
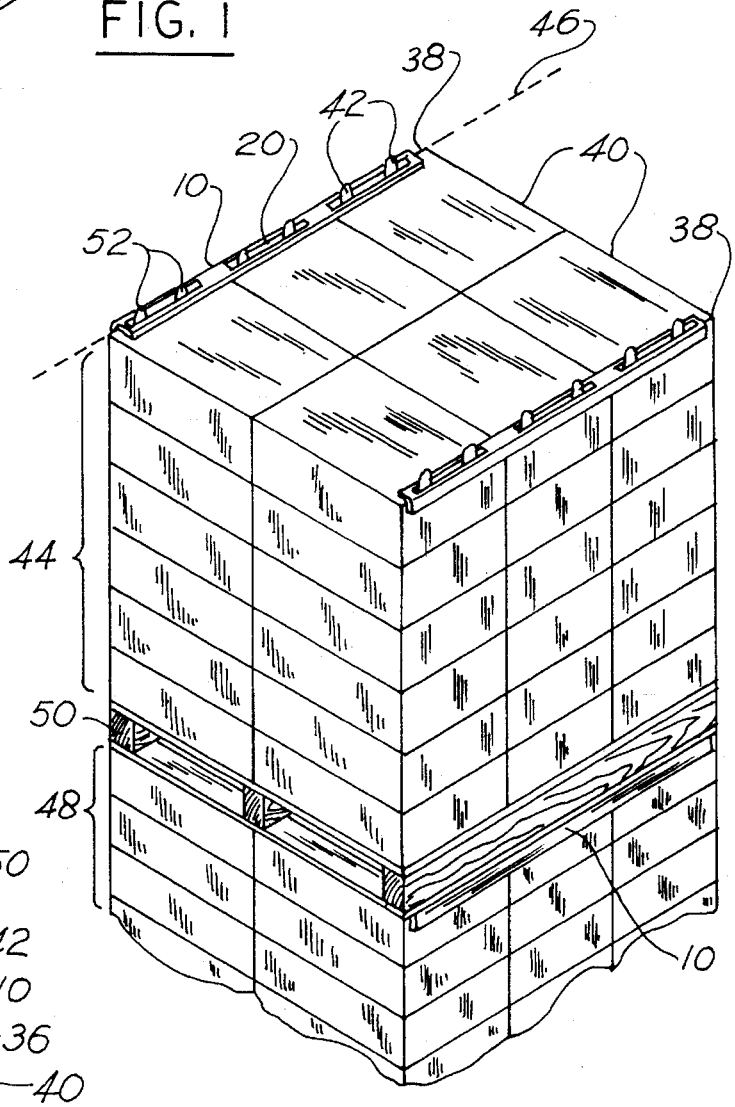
FIG. 3 is a top perspective view showing two stacked palletized units utilizing my interlocking invention.

The apparatus 10 is formed from a rectangular strip of material 18. The strip 18 is folded or bent along its longitudinal axis 19 at substantially a fight angle thus forming two sides or margins, 12 and 14, and an edge 16 as shown in FIG. 1. Each side or margin is approximately two and one-half inches wide. The length of the interlocking apparatus 10 is slightly shorter than the length of the pallet 50 upon which the corrugated cardboard cartons 40 are stacked. Material is removed from at least one side or margins 14 forming elongated slots 20. The location as well as the lengths and widths of the slots 20 correspond with the placement of the stacking tabs 42 on stacked or palletized cartons 40. As shown in FIG. 3, more than one tab 42 can be received in each slot 20. Alternatively, the location, length, and width of each slot 20 could correspond to exactly one tab 42.

Figure 2:
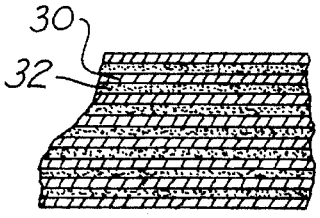
FIG. 2 is an exploded end view of my invention showing a laminated paper construction.

As shown in FIG. 2, my invention 10 is preferably manufactured from sheets of paper 30 laminated together with glue 32 or another suitable adhesive. Glue 32 is applied between sheets of paper 30. The resulting composite material is then bent at substantially a right angle along edge 16 and pressure is applied to outer side 34 and inner side 36 of the interlocking apparatus 10 until the glue has dried and the rigid structure is formed. The slots 20 are then created by die cutting or another material removal process. While the apparatus 10 shown in FIGS. 1 and 3 has slots 20 only on side 14, additional slots 20 could be formed in both sides 12 and 14. In some applications, having slots 20 in both sides or margins makes it easier to install my interlocking apparatus 10 on palletized cartons 40.

Figure 4:
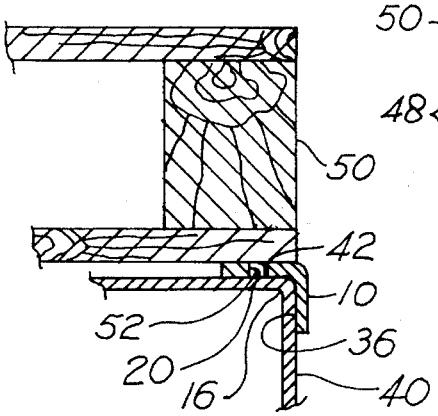
FIG. 4 is a cut-away partial end view of the interface of two stacked palletized units and my invention.

The longitudinal axes of the tabs 42 in the top outer cartons 40 in a stacked or palletized load of cartons 44 are aligned during stacking such that they fall in a common line 46. My invention 10 is placed on the edge 38 of the adjacent cartons 40 and over the aligned tabs 42 as shown in FIG. 3 such that the tabs 42 are received within the slots 20. As shown in FIG. 4, the inner surface 36 and edge 16 of the interlocking apparatus 10 fits snugly against the edge 38 of the carton 40. Once installed, the apparatus 10 prevents the cartons 40 on the top layer of the load from dislodging or collapsing and thus causing load failure.

Furthermore, my invention 10 provides edge protection to the upper edges 38 of the palletized load of cartons 44. If the pallet of a second palletized load to be stacked on top of the first palletized load strikes the upper edge 38 of the top layer of cartons 40, the location and structural integrity of the interlocking apparatus 10 prevents damage to the top layer of cartons 40.

When a second palletized load 44 is placed on top of a first load 48 as shown in FIG. 3, the apparatus 10 provides a flat even surface for the first load 48. Furthermore, the apparatus 10 is locked into place by second load 44. Because the tabs 42 of cartons 40 are located within slots 20, the apparatus 10 cannot slide out of place. Despite the fact that the tops 52 of some tabs 42 may extend above the outer surface 34 of the interlocking apparatus 10 and may be partially crushed by the second palletized load 44, the cartons are still locked in place by the invention 10 and cannot be dislodged during further stacking, moving, or shipping. Because stacking tabs 42 are not completely crushed, but fill the slots 20, they will still function in their originally intended manner when the interlocking apparatus 10 is removed.

Because the interlocking apparatus 10 is not permanently attached to the edges of the palletized cartons 40, it is fully reusable.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. An apparatus for interlocking adjacent cartons, each carton having tabs on at least one outer surface, the apparatus comprising:

a substantially rigid member having two flat elongated sides connected to and divided by a bend;

a plurality of slots for receiving the carton tabs being formed in at least one of the sides.

2. The apparatus of claim 1 formed from sheets of paper laminated together with an adhesive.

3. The apparatus of claim 1 wherein the plurality of slots are formed in both sides.

4. An apparatus for preventing adjacent cartons from dislodging or collapsing during stacking and shipping, each carton having tabs on at least one outer surface, the apparatus comprising:

a rectangular strip of material divided by a longitudinal axis;

the strip being bent at substantially a right angle along the longitudinal axis and having two margins adjacent the bend;

at least one margin having material removed forming a plurality of slots for receiving the carton tabs when the bent strip is placed upon the stacked or palletized cartons.

5. The apparatus of claim 4 wherein the strip comprises sheets of paper laminated together with an adhesive.

6. The apparatus of claim 4 wherein material is removed from both margins forming a plurality of slots on each side.

7. A method for interlocking adjacent stacked cartons to prevent them from dislodging or collapsing during further stacking or shipping, each carton having tabs on at least one outer surface, the method comprising the steps of:

stacking the cartons whereby at least one tab from each carton lies in a common line with a tab on an adjacent carton;

placing at least one elongated piece of material, the material having two flat sides at substantially right angles to each other and having material removed from at least one side forming a plurality of openings for receiving the aligned tabs, on the edge of the adjacent cartons whereby the tabs are received within the openings.

8. A method for interlocking a first stacked load of cartons, each carton having at least one stacking tab, utilizing a rigid elongated member having two flat sides, the sides being at substantially right angles to one another, a plurality of slots being formed in at least one side for receiving the tabs, the method comprising the steps of:

aligning the tabs on the top cartons on at least one side of the stack such that at least one tab from each carton lies in a common line;

placing the rigid elongated member along an edge of the stacked cartons such that the tabs are received within the slots.

9. The method of claim 8 further including the step of placing a second palletized load of cartons upon the first palletized load whereby the second palletized load holds the rigid elongated member securely in place.

* * * * *

UNITED STATES PATENT AND TRADEMARK OFFICE

CERTIFICATE OF CORRECTION

PATENT NO. : 5,524,760

DATED : June 11, 1996

INVENTOR(S) : LYN FUNK,

It is certified that error appears in the above-indentified patent and that said Letters Patent is hereby corrected as shown below:

Column 1, Line 63, delete "fight" and insert --right--

Column 2, Line 6, delete "the my" and insert --my--

Column 2, Line 63, delete "fight" and insert --right--

Signed and Sealed this

First Day of October, 1996

Bruce Lehman

*Attest:*

BRUCE LEHMAN

*Attesting Officer*

*Commissioner of Patents and Trademarks*